US009034123B2

(12) United States Patent
Gao et al.

(10) Patent No.: US 9,034,123 B2
(45) **Date of Patent: *May 19, 2015**

(54) CU—NI—SI-BASED COPPER ALLOY SHEET MATERIAL AND METHOD OF MANUFACTURING SAME

(75) Inventors: Weilin Gao, Iwata (JP); Hisashi Suda, Iwata (JP); Hiroto Narieda, Hamamatsu (JP); Akira Sugawara, Iwata (JP)

(73) Assignee: DOWA METALTECH CO., LTD., Tokyo (JP)

( * ) Notice: Subject to any disclaimer, the term of this patent is extended or adjusted under 35 U.S.C. 154(b) by 1618 days.

This patent is subject to a terminal disclaimer.

(21) Appl. No.: 12/068,795

(22) Filed: Feb. 12, 2008

(65) Prior Publication Data

US 2008/0190524 A1 Aug. 14, 2008

Related U.S. Application Data

(63) Continuation-in-part of application No. 11/826,223, filed on Jul. 13, 2007, now abandoned.

(30) Foreign Application Priority Data

Feb. 13, 2007 (JP) ..... 2007-032623
Dec. 18, 2007 (JP) ..... 2007-326559

(51) Int. Cl.
*C22C 9/06* (2006.01)
*C22F 1/08* (2006.01)
*H01R 13/03* (2006.01)

(52) U.S. Cl.
CPC ... *C22C 9/06* (2013.01); *C22F 1/08* (2013.01); *H01R 13/03* (2013.01)

(58) Field of Classification Search
USPC ..... 148/435, 414, 433, 682; 420/485, 486, 420/487, 488
IPC ..... C22C 9/06; C22F 1/08; H01R 13/03
See application file for complete search history.

(56) References Cited

FOREIGN PATENT DOCUMENTS

| | | | |
|---|---|---|---|
| JP | 2000-080428 | | 3/2000 |
| JP | 2006-009108 | | 1/2006 |
| JP | 2006-009137 | | 1/2006 |
| JP | 2006-016629 | | 1/2006 |
| JP | 2006-16629 A | | 1/2006 |
| JP | 2006016629 | * | 1/2006 |
| JP | 2006-152392 | | 6/2006 |

* cited by examiner

*Primary Examiner* — Sikyin Ip
(74) *Attorney, Agent, or Firm* — Clark & Brody

(57) ABSTRACT

This invention provides a copper alloy sheet material containing, in mass %, Ni: 0.7%-4.2% and Si: 0.2%-1.0%, optionally containing one or more of Sn: 1.2% or less, Zn: 2.0% or less, Mg: 1.0% or less, Co: 2.0% or less, and Fe: 1.0% or less, and a total of 3% or less of one or more of Cr, B, P, Zr, Ti, Mn and V, the balance being substantially Cu, and having a crystal orientation satisfying Expression (1):

$$I\{420\}/I_0\{420\}>1.0 \quad (1),$$

where I{420} is the x-ray diffraction intensity from the {420} crystal plane in the sheet plane of the copper alloy sheet material and $I_0\{420\}$ is the x-ray diffraction intensity from the {420} crystal plane of standard pure copper powder. The copper alloy sheet material has highly improved strength, post-notching bending workability, and stress relaxation resistance property.

10 Claims, 3 Drawing Sheets

CU—NI—SI-BASED COPPER ALLOY SHEET MATERIAL AND METHOD OF MANUFACTURING SAME

This application is a continuation-in-part of U.S. application Ser. No. 11/826,223 filed Jul. 13, 2007, which is hereby incorporated by reference, now abandoned.

BACKGROUND OF THE INVENTION

1. Field of the Invention

This invention relates to a Cu—Ni—Si-based copper alloy sheet material suitable for use in electrical and electronic parts such as connectors, lead frames, relays, switches and the like, particularly to a copper alloy sheet material that exhibits excellent bending workability and stress relaxation resistance property while maintaining high strength and high conductivity, and a method of manufacturing the same.

2. Background Art

The connectors, lead frames, relays, switches and other current-carrying components of electrical and electronic parts require good conductivity for minimizing generation of joule heat due to passage of current and also require high strength capable of enduring stress imparted during assembly and/or operation of the electrical or electronic parts. Because electrical and electronic parts are generally formed by bending, the current-carrying components must also have excellent bending workability. Moreover, in order to ensure contact reliability between the electrical and electronic parts, they require endurance against the tendency for contact pressure to decline over time (stress relaxation), namely, they need to be excellent in stress relaxation resistance property.

Of particular note is that as electrical and electronic parts have become more densely integrated, smaller, and lighter in weight in recent years, demand has increased for thinner copper and copper alloy materials for use in the parts. This in turn has led to still severer requirements regarding the level of material strength. To be more specific, a strength level expressed as tensile strength of 700 MPa or greater, preferably 750 MPa or greater, is desired.

Further, the emergence of smaller and more complexly shaped electrical and electronic parts has created a strong need for improved shape and dimensional accuracy in components fabricated by bending. Recently, therefore, increased use is being made of a bending method in which the starting material is notched at the location to be bent and bending is later carried out along the notch (sometimes called the "notch-and-bend method" in the following). With this method, however, the notching work-hardens the vicinity of the notch, so that cracking is apt to occur during the ensuing bending. The notch-and-bend method can therefore be viewed as a very harsh bending method from the viewpoint of the material.

In addition, the fact that more and more electrical and electronic parts are being utilized in severe environment applications has made stress relaxation resistance property an increasingly critical issue. Stress relaxation resistance property is of particular importance when the part is exposed to a high-temperature environment as in the case of an automobile connector. "Stress relaxation" refers to the phenomenon of, for instance, a spring member constituting an element of an electrical or electronic part experiencing a decline in contact pressure with passage of time in a relatively high-temperature environment of, say, 100 to 200° C., even though it might maintain a constant contact pressure at normal temperatures. It is thus one kind of creep phenomenon. To put it in another way, it is the phenomenon of stress imparted to a metal material being relaxed by plastic deformation owing to dislocation movement caused by self-diffusion of atoms constituting the matrix and/or diffusion of solute atoms.

But there are tradeoffs between strength and conductivity, strength and bending workability, and bending workability and stress relaxation resistance property. Up to now, the practice regarding such current-carrying components has been to take the purpose of use into account in suitably selecting a material with optimum conductivity, strength, bending workability or stress relaxation resistance property.

Cu—Ni—Si-based alloy (known as Corson alloy) has attracted attention in recent years for its excellent balance between strength and conductivity. Copper alloy of this type can be markedly improved in strength while still retaining relatively high conductivity (of 30% to 45% IACS). However, Cu—Ni—Si-based alloy is known to be an alloy system that is difficult to make excellent in both strength and bending workability or both bending workability and stress relaxation resistance property.

Strength can be increased by such commonplace methods as adding a greater amount of solute elements like Ni and Si and increasing the rolling reduction ratio following aging treatment. However, the former method reduces conductivity and causes bending workability to decline with increasing amount of Ni—Si type precipitates. The latter method increases work-hardening, thereby degrading bending workability (particularly bending workability perpendicular to the rolling direction, i.e., bending workability with respect to a bending axis lying parallel to the rolling direction). Thus while a high strength level and a high conductivity level may be achieved, it may become impossible to form the electrical or electronic part.

A method commonly used to avoid a decrease in bending workability is to omit (or minimize) post-aging finish cold rolling and make up for the strength loss this causes by adding large amounts of solute elements such as Ni and Si. However, this method increases the tendency of work-hardening for the material, so that when the notch-and-bend method is adopted, the notching markedly increases hardness in the vicinity of the notch. A problem therefore arises of the bending workability being radically degraded at the time of bending the material along the notch.

Refinement of crystal grain size effectively improves bending workability. So it is a common practice to carry out the solution heat treatment of the Cu—Ni—Si-based alloy not in a high-temperature region so that all precipitates (or crystallization products) enter into solid solution but in a relatively low-temperature region so that some precipitates (or crystallization products) remain to have a pinning effect on recrystallization grain growth. However, while it may be possible to achieve crystal grain refinement in this case, the amount of Ni and Si entering solid solution is reduced, which inevitably lowers the strength level after aging treatment.

Moreover, the crystal grain boundary area per unit volume increases with decreasing crystal grain diameter. Crystal grain refinement therefore promotes stress relaxation, which is a type of creep phenomenon. Particularly in the case of vehicle-mounted connectors and other high-temperature environment applications, the diffusion velocity of the atom along grain boundaries is extremely high than that within the grains, so that the loss of stress relaxation resistance property caused by crystal grain refinement becomes a major problem.

In recent years, control of crystal orientation (texture) has been proposed for improving the bending workability of Cu—Ni—Si-based alloys (see patent documents 1 to 5).

Patent Document 1: JP2000-80428A

Patent Document 2: JP2006-9108A

Patent Document 3: JP2006-16629A
Patent Document 4: JP2006-9137A
Patent Document 5: JP2006-152392A It is well known that crystal grain refinement and control of crystal orientation (texture) are effective for improving the bending workability of copper alloy sheet material. Regarding control of the crystal orientation (texture) of Cu—Ni—Si-based copper alloy, in the case where ordinary manufacturing processes are utilized, the X-ray diffraction pattern from the sheet surface (rolled surface) is generally dominated by diffraction peaks from the four crystal planes {111}, {200}, {220} and {311}, and the X-ray diffraction intensities from other crystal planes are very weak compared with those from these four planes. The diffraction intensities from the {200} plane and the {311} plane are usually large after solution heat treatment (recrystallization). The ensuing cold rolling lowers the diffraction intensities from these planes, and the X-ray diffraction intensity from the {220} plane increases relatively. The X-ray diffraction intensity from the {111} plane is usually not much changed by the cold rolling.

In order to improve bending workability, Patent Document 1 defines the ratio of the sum of the X-ray diffraction intensities from the {200} plane and the {311} plane to the X-ray diffraction intensity from the {220} plane as:

$$(I\{200\}+I\{311\})/I\{220\}>0.5.$$

This relational expression suggests that bending workability improves when the reduction ratio in the cold rolling conducted after solution heat treatment is lowered. This kind of texture regulation usually lowers strength. And, in fact, tensile strength of the copper alloy provided by Patent Document 1 is only on the order of 560 to 670 MPa.

Patent Documents 2 and 3 point out that the fact that bending workability is anisotropic makes it difficult to improve bending workability simultaneously both for the case where the bending axis lies perpendicular to the rolling direction (G.W.) and for the case where it lies parallel to the rolling direction (B.W.). It therefore separately defines means for improving G.W. bending workability and means for improving B.W. bending workability. That is, the former means is to make the ratio of the sum of the X-ray diffraction intensities from the {111} plane and the {311} plane to the X-ray diffraction intensity from the {220} plane, i.e., (I{111}+I{311})/I{220}, not greater than 2.0 and the latter means is to make the ratio not less than 2.0.

In order to improve bending workability, Patent Document 4 defines the X-ray diffraction intensities from the {311} plane, {220} plane and {200} plane as a function of crystal grain diameter A, as follows:

$$I\{311\}\times A/(I\{311\}+I\{220\}+I\{200\})<1.5.$$

Patent Document 5 defines the percentage of cube orientation [{001}<100>] as 50% or greater and the average crystal grain diameter as 10 μm or less. These techniques require crystal grain refinement. The stress relaxation resistance property generally decreases in such cases.

Use of the aforesaid notch-and-bend method on a copper alloy sheet material effectively improves the shape and dimensional accuracy of the bent product. However, even in the Cu—Ni—Si-based alloys improved in bending workability by texture control as in Patent Documents 1 to 5, no consideration is given to preventing cracking caused by the notch-and-bend method, indicating that the post-notching bending workability is not sufficiently improved.

Moreover, while, as mentioned in the foregoing, crystal grain refinement is effective for improving bending workability, it is a negative factor with regard to overcoming stress relaxation, which is one type of creep phenomenon. Because of this, and the fact that achieving a high degree of improvement is difficult even with to regard bending workability alone, still further improvement of stress relaxation resistance property cannot be achieved even by using the prior art texture control.

SUMMARY OF THE INVENTION

In light of the foregoing circumstances, an object of the present invention is to provide a Cu—Ni—Si-based copper alloy that retains high strength while simultaneously achieving the demanding bending workability required in the notch-and-bend method and the stress relaxation resistance property needed to ensure reliability in the harsh use environments of, for example, vehicle-mounted connectors.

Through an in-depth study, the inventors discovered that there exists a crystal orientation with an orientation relationship such that deformation easily occurs in a direction normal to a surface of a rolled sheet (ND direction) and also occurs easily in two mutually perpendicular directions within the sheet surface. In addition, the inventors determined an alloy composition range and manufacturing conditions enabling establishment of a texture composed mainly of crystal grains having this unique orientation relationship. The present invention was accomplished based on this knowledge.

Specifically, the present invention provides a copper alloy sheet material containing, in mass %, Ni: 0.7%-4.2% and Si: 0.2%-1.0%, optionally containing one or more of Sn: 1.2% or less, Zn: 2.0% or less, Mg: 1.0% or less, Co: 2.0% or less and Fe: 1.0% or less, and a total of 3% or less of one or more of Cr, B, P, Zr, Ti, Mn and V, the balance being substantially Cu, and having a crystal orientation satisfying Expression (1) and preferably also satisfying Expression (2):

$$I\{420\}/I_0\{420\}>1.0 \quad (1),$$

$$I\{220\}/I_0\{220\}\leq 3.0 \quad (2),$$

In the Expressions, I{420} is the X-ray diffraction intensity from the {420} crystal plane in the sheet plane of the copper alloy sheet material and $I_0\{420\}$ is the x-ray diffraction intensity from the {420} crystal plane of standard pure copper powder and, similarly, I{220} is the X-ray diffraction intensity from the {220} crystal plane in the sheet plane of the copper alloy sheet material and $I_0\{220\}$ is the x-ray diffraction intensity from the {220} crystal plane of standard pure copper powder. I{420} and $I_0\{420\}$ are measured under the same measurement conditions and so are I{220} and $I_0\{220\}$. By "the balance being substantially Cu" is meant that inclusion of elements other than those set out above is permissible within ranges that do not impair the effects of the present invention. Thus, cases in which the balance is Cu and unavoidable impurities are included.

A copper alloy sheet material of the foregoing description having an average crystal grain diameter of 10 μm-60 μm is particularly preferable. The grain diameter is determined by the cutting method of JIS H 0501, specifically by polishing and then etching the sheet surface (rolled surface) and observing the surface with a microscope.

A method of manufacturing this copper alloy sheet is provided that comprises successively subjecting a copper alloy regulated to the foregoing composition to the steps of hot rolling at 950° C.-400° C., cold rolling at a reduction ratio of 85% or greater, solution heat treatment at 700° C.-850° C., intermediate cold rolling at a reduction ratio of 0%-50%, aging at 400° C.-500° C., and finish cold rolling at a reduction ratio of 0%-50%, in the hot rolling step of which method a first pass is conducted in a temperature range of 950° C.-700° C., preferably in a temperature range of 950° C.-700° C. at a reduction ratio of 60% or greater, and rolling is conducted in a temperature range of less than 700° C. to 400° C. at a reduction ratio of 40% or greater.

The reduction ratio $\epsilon$ (%) in a given temperature range is defined by the following Expression (3), $$\epsilon=(t_0-t_1)/t_0\times 100 \quad (3),$$

where $t_0$ (mm) is the sheet thickness before the first rolling pass among consecutive rolling passes conducted in the temperature range and $t_1$ (mm) is the sheet thickness after completion of the final rolling pass among the rolling passes.

By "hot rolling at 950° C.-400° C." is meant that rolling passes of the hot rolling are conducted in the range of 950° C.-400° C. In the intermediate cold rolling and finish cold rolling, a reduction ratio of 0% means that the rolling is not conducted. In other words, one or both of the intermediate cold rolling and the finish cold rolling can be omitted.

In the solution heat treatment, the heating time from 100° C. to 700° C. is preferably 20 sec or less and the solution heat treatment is preferably conducted by setting the holding time in the range of 700° C.-850° C. and the ultimate temperature so that the average crystal grain diameter after solution heat treatment becomes 10 μm-60 μm. When finish cold rolling is conducted, 150° C.-550° C. low-temperature annealing is preferably conducted after the finish cold rolling.

The present invention provides a Cu—Ni—Si-based copper alloy sheet material having the basic properties required by connectors, lead frames, relays, switches and other such electrical and electronic parts, namely, a Cu—Ni—Si-based copper alloy sheet material of high strength having a tensile strength of 700 MPa or greater, excellent bending workability and stress relaxation resistance property, and excellent bending workability after notching. Conventional Cu—Ni—Si-based copper alloy manufacturing methods have not been capable of consistently achieving marked improvement of bending workability and stress relaxation resistance property while maintaining a high strength level, namely, a tensile strength of 700 MPa or greater. This invention provides a solution in response to the trend toward smaller and thinner electrical and electronic parts, which is expected to accelerate even further in the future.

DESCRIPTION OF THE PREFERRED EMBODIMENT

Texture

As explained earlier, the X-ray diffraction pattern from the Cu—Ni—Si-based copper alloy sheet surface (rolled surface) generally includes diffraction peaks from the four crystal planes {111}, {200}, {220} and {311}, and the X-ray diffraction intensities from other crystal planes are very weak compared with those from these four planes. In a Cu—Ni—Si-based copper alloy sheet obtained by the ordinary manufacturing process, the diffraction intensity from the {420} plane is so weak as to be negligible. However, a thorough study carried out by the inventors revealed that when manufacturing is carried out in accordance with the conditions set out in the following, a Cu—Ni—Si-based copper alloy sheet material having a texture whose main orientation component is the {420} plane is obtained. In addition, the inventors discovered that the stronger the development of this texture becomes, the more advantageous it is for improvement of bending workability. The mechanism of the bending workability improvement is at present believed to be as follows.

The Schmid factor is an index of ease of plastic deformation (slip) when an external force acts on a crystal in a certain direction. Where the angle between the direction of force application to the crystal and the normal to the slip surface is designated $\phi$ and the angle between the direction of force application to the crystal and the slip direction is designated $\lambda$, the Schmid factor is represented by $\cos\phi\cdot\cos\lambda$ and the value thereof falls in the range of 0.5 or less. A larger Schmid factor (one closer to 0.5) means a larger shear stress in the slip direction. From this it follows that when a force is applied to a crystal in a certain direction, the ease of crystal deformation increases with increasing magnitude of the Schmid factor (increasing proximity to 0.5). The crystal structure of the Cu—Ni—Si-based copper alloy is face centered cubic (fcc). In the slip system of face centered cubic crystal, the slip plane is {111} and the slip direction is <110>, and it is known that in the actual crystal, deformation more readily occurs and work-hardening decreases in proportion as the Schmid factor is larger.

Figure 1:
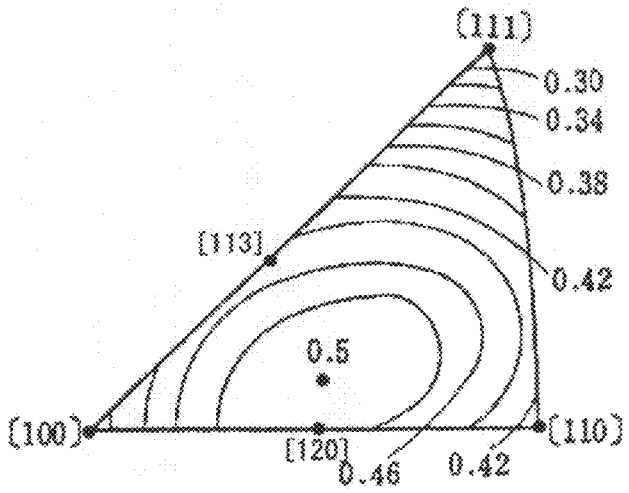
FIG. 1 is a standard inverse pole figure showing the Schmid-factor distribution of face centered cubic crystal.

FIG. 1 is a standard inverse pole figure showing the Schmid factor distribution of face centered cubic crystal. The Schmid factor in the <120> direction is 0.490, which is close to 0.5. In other words, when an external force is applied in the <120> direction, the face centered cubic crystal deforms very easily. The Schmid factors in the other directions are: <100> direction, 0.408; <113> direction 0.445; <110> direction, 0.408; <112> direction, 0.408; and <111> direction, 0.272.

To say that a texture's main orientation component is the {420} plane means that the proportion of crystals whose {420} plane (and {210} plane) lie substantially parallel to the sheet surface (rolled surface) is high. In a crystal whose main orientation plane is the {210} plane, the direction normal to the sheet surface (ND) is the <120> direction and its Schmid factor is near 0.5, so that it readily deforms in the ND and work-hardening is low. On the other hand, the rolled texture of the Cu—Ni—Si-based alloy ordinarily has the {220} plane as its main orientation component. In this case, the proportion of crystals whose {220} plane (and {110} plane) lie substantially parallel to the sheet surface (rolled surface) is high. In a crystal whose main orientation plane is the {110} plane, the ND is the <110> direction and its Schmid factor is on the order of 0.4, so that work-hardening upon deformation in the ND is large compared with that in the case of a crystal whose main orientation plane is the {210} plane. The recrystallized texture of the Cu—Ni—Si-based alloy ordinarily has the {311} plane as its main orientation component. In a crystal whose main orientation plane is the {311} plane, the ND is the <113> direction and its Schmid factor is on the order of 0.45, so that work-hardening upon deformation in the ND is large compared with that in the case of a crystal whose main orientation plane is the {210} plane.

In the notch-and-bend method, the degree of work-hardening at the time of deformation in the direction normal to the sheet surface (ND) is very important. This is because notching is indeed deformation in the ND, and the degree of work-hardening at the portion reduced in thickness by the notching strongly governs the bending workability during subsequent bending along the notch (see FIG. 7 discussed later). In the case of a texture such as one satisfying Expression (1) that has the {420} plane as its main orientation component, work-hardening caused by notching becomes small in comparison with that in the case of the rolled texture or recrystallized texture of the Cu—Ni—Si-based alloy. This is considered to be the reason for the marked improvement in bending workability in the notch-and-bend method.

Moreover, in the case of a texture such as one satisfying Expression (1) that has the {420} plane as its main orientation component, the <120> direction and <210> direction are present as other directions in the sheet plane, i.e., in the {210} plane, in the crystal whose main orientation plane is the {210} plane, and these directions are mutually perpendicular. And in fact, it has been ascertained that the rolling direction (LD) is the <100> direction and the direction perpendicular to the rolling direction (TD) is the <120> direction. To illustrate using specific crystal directions, in a crystal whose main orientation plane is the {120} plane, for example, the LD is the [001] direction and the TD is the [−2, 1, 0] direction. The Schmid factors of such a crystal are LD: 0.408 and TD: 0.490. In contrast, in the case of the ordinary rolled texture of the Cu—Ni—Si-based alloy that is crystal having the {110} plane as its main orientation plane, LD is the <112> direction and TD is the <111> direction, and the Schmid factors are LD: 0.408 and TD: 0.272. In the case of the ordinary recrystallized texture of the Cu—Ni—Si-based alloy that is crystal having the {113} plane as its main orientation plane, LD is the <112> direction and TD is the <110> direction, and the Schmid factors are LD: 0.408 and TD: 0.408. Thus, considering the Schmid factors of the LD and the TD, it can be concluded that when the texture has the {420} plane as its main orientation component, deformation in the sheet surface is easier than in the cases of the rolled texture and recrystallized texture of the conventional Cu—Ni—Si-based alloy. This is also thought to work favorably toward preventing cracking during bending after notching.

When a metal sheet is bent, the deformation is not uniform because crystal orientation differs among the individual crystal grains. During bending, therefore, some crystal grains deform easily and some crystal grain resist deformation. As the degree of bending increases, deformation of the easily deformed crystal grains proceeds with increasing precedence, so that microscopic surface roughness occurs at the bend owing to uneven deformation among the crystal grains. The roughness develops into wrinkles and may even produce cracks (fractures). In a metal sheet having a texture satisfying Expression (1) as explained in the foregoing, the crystal grains deform more easily in the ND than they do in a conventional metal sheet and deformation within the sheet is also easy. This is thought to be why marked improvements in bending workability after notching and in ordinary bending workability are brought about A study conducted by the inventors found that such a crystal orientation can be defined by the following Expression (1):

$$I\{420\}/I_0\{420\}>1.0 \quad (1),$$

where I{420} is the X-ray diffraction intensity from the {420} crystal plane in the sheet plane of the copper alloy sheet material and $I_0\{420\}$ is the X-ray diffraction intensity from the {420} crystal plane of standard pure copper powder.

In the X-ray diffraction pattern of face centered cubic crystal, reflection from the {420} plane is observed but no reflection from the {210} plane is observed, so the crystal orientation of the {210} plane is judged from the {420} plane reflection. Still more preferable is to satisfy the following Expression (1)'.

$$I\{420\}/I_0\{420\}>1.5 \quad (1)'.$$

The texture whose main orientation component is the {420} plane is formed as a recrystallized texture by the solution heat treatment explained later. However, it is highly effective for imparting high strength to the copper alloy sheet material to cold roll it after the solution heat treatment. The cold rolling consists of the intermediate cold rolling and finish cold rolling explained later but increasing the reduction ratio of the cold rolling inhibits development of a rolled texture whose main orientation component is the {220} plane. Although the {420} orientation density decreases as the {220} orientation density increases, it suffices to regulate the reduction ratio to maintain the relationship of Expression (1) or preferably Expression (1)'. Still, it is preferable to satisfy Expression (2) below because excessive development of the texture whose main orientation component is the {220} plane may cause a decline in workability. Further, from the viewpoint of good balance between strength and bending workability at a high level, it is still more preferable to satisfy the following Expression (2)'.

$$I\{220\}/I_0\{220\}\leq 3.0 \quad (2).$$

$$0.5\leq I\{220\}/I_0\{220\}\leq 3.0 \quad (2)',$$

where I{220} is the X-ray diffraction intensity from the {220} crystal plane in the sheet plane of the copper alloy sheet material and $I_0\{220\}$ is the X-ray diffraction intensity from the {220} crystal plane of standard pure copper powder.

Average Crystal Grain Diameter

As explained in the foregoing, a smaller average crystal grain diameter is advantageous for improving bending workability but apt to degrade stress relaxation resistance property when too small. From the results of various studies, it was found that a final average crystal grain diameter of 10 μm or greater, preferably exceeding 10 μm, is suitable because it facilitates realization of a stress relaxation resistance property of a level satisfactory even for vehicle-mounted connector applications. However, an excessively large average crystal grain diameter is apt to cause surface roughening at bends and may degrade bending workability, so it is preferably made to fall in the range of not greater than 60 μm. Regulation to within the range of 15 to 40 μm is desirable. The final average crystal grain diameter is substantially determined by the crystal grain diameter at the stage following solution heat treatment. The average crystal grain diameter can therefore be controlled by controlling the solution heat treatment conditions explained later.

Alloy Composition

The present invention utilizes a Cu—Ni—Si-based copper alloy. Cu—Ni—Si-based copper alloy as termed in this specification also includes copper alloys obtained by adding Sn, Zn and other alloying elements to a basic three-element Cu—Ni—Si composition.

Ni and Si form precipitates and contribute to strength enhancement and improvement of electrical conductivity and thermal conductivity. These effects are hard to effectively elicit at a content of Ni of less than 0.7 mass % or a content of Si of less than 0.2 mass percent. On the other hand, an excessive Ni content or an excessive Si content is apt to cause formation of coarse precipitates that tend to degrade bending workability and stress relaxation resistance property. In addition, development of a recrystallization texture whose main orientation component is the {420} plane becomes hard to achieve in the solution heat treatment, which makes it difficult to realize a final sheet material excellent in bending workability. The Ni content therefore needs to be made not greater than 4.2 mass %, preferably not greater than 3.5 mass %, still more preferably not greater than 3.0 mass %. The Si content must be made not greater than 1.0 mass %, preferably not greater than 0.7 mass %. The most preferable content range of Ni is 1.2 mass %-2.5 mass % and the most preferable content range of Si is 0.3 mass %-0.6 mass %.

The Ni—Si-based precipitates formed by Ni and Si are thought to be intermetallic compounds consisting chiefly of $Ni_2Si$. However, the Ni and Si in the alloy may not all be converted to precipitates by the aging treatment but to some extent may be present in the Cu matrix in solid solution. The Ni and Si present in solid solution enhance strength somewhat but have a smaller effect than when in the precipitated state. They also degrade conductivity. The Ni to Si content ratio is therefore preferably brought as close as possible to that in the $Ni_2Si$ precipitate. In this invention, therefore, the Ni and Si contents expressed in mass % are adjusted to establish an Ni to Si ratio of between 3.0 and 6.0, preferably between 3.5 and 5.0. However, in the case of addition of other elements that can form precipitates with Si, such as Co, Cr and others specified below, the Ni to Si ratio is preferably adjusted to within the range of 3.0 to 4.0.

Sn has a solid solution strengthening effect and an effect of improving stress relaxation resistance property. For Sn to thoroughly exert these effects, a content of 0.1 mass % or greater is preferable. When the Sn content exceeds 1.2 mass %, however, conductivity drops sharply. When Sn is included, therefore, its content must be made 1.2 mass % or less. The Sn content is preferably adjusted to the range of 0.1 mass %-1.2 mass %, more preferably 0.2 mass %-0.7 mass %.

Zn improves solderability and strength, and also has an effect of improving ease of casting. Moreover, when Zn is included, there is the merit of being able to use inexpensive brass scrap. However, a Zn content exceeding 2.0 mass % is apt to degrade conductivity and stress corrosion cracking resistance. Therefore, when Zn is included, its content is made 2.0 mass % or less. A Zn content of 0.1 mass % or greater is preferably established so that the foregoing effects can be thoroughly obtained, and adjustment of the content to within the range of 0.3 mass %-1.0 mass % is particularly preferable.

Mg has an effect of improving stress relaxation resistance property and a desulfurization effect. For thorough manifestation of these effects, it is preferable to establish an Mg content of 0.01% or greater. However, Mg is an easily oxidized element and markedly degrades ease of casting when present at a content of greater than 1.0 mass %. Therefore, when Mg is included, its content must be made 1.0 mass % or less. The Mg content is preferably 0.01 mass %-1.0 mass %, more preferably 0.1 mass %-0.5 mass %.

Co is an element that can form a precipitate with Si and can also precipitate as a simple substance. So when Co is included, it reacts with Si present in solid solution in the Cu matrix to form a precipitate and the excess Co precipitates as a simple substance. As a result, an effect of simultaneously improving strength and conductivity can be obtained. For thorough manifestation of these effects, a Co content of 0.1 mass % is preferably established. However, Co is an expensive element that increases cost when added in excess. When Co is included, therefore, its content is made 2.0 mass % or less. The Co content is preferably 0.1 mass % to 2.0 mass % and is more preferably adjusted to within the range of 0.5 mass %-1.5 mass %.

Fe has an effect of suppression in forming the {220} orientation due to promotion in forming the {200}, {420} and the likes recrystallization orientations after solution heat treatment. Specifically, when appropriate amounts of Fe are contained, it is apt to occur the decrease of the {220} orientation density and the increase of the {420} orientation density, which contributes to enhance bending workability. In order to obtain the effects sufficiently, a Fe content of 0.01 mass % or greater is preferably established. However, an excessive Fe content is apt to cause an excessive formation of the {200} orientation, thereby to cause decrease of {420} orientation density. Therefore, the Fe content should be 1.0 mass % or less when Fe is contained. Thus, the Fe content is desired to be within the range of 0.01 mass %-1.0 mass %, more preferably within the range of 0.1 mass %-0.5 mass %.

Other elements that can be incorporated as required include Cr, B, P, Zr, Ti, Mn and V. Cr, B, P, Zr, Ti, Mn and V act to heighten alloy strength and reduce stress relaxation. Cr, Zr, Ti, Mn and V readily form high melting point compounds with S, Pb and other elements present as unavoidable impurities. B, P, Zr and Ti have an effect of refining the grain size of the cast structure and can contribute to hot workability improvement. When one or more of Cr, B, P, Zr, Ti, Mn and V are included, it is preferable for realizing the full effect of the elements to make the total amount included 0.01 mass % or greater. However, inclusion of a large quantity degrades hot and/or cold workability and is disadvantageous from the viewpoint of cost. Therefore, the total content of these elements is preferably in the range of 3 mass % or less, more preferably in the range of 2 mass % or less, still more preferably in the range of 1 mass % or less, and most preferably in the range of 0.5 mass % or less.

Properties

In order to cope with the ongoing size and thickness reduction of electrical and electronic parts, the copper alloy sheet material used as a starting material should preferably have a tensile strength of 700 MPa or greater, preferably 750 MPa or greater. Where the rolling direction is called the LD (longitudinal direction) and the direction perpendicular to the rolling direction and thickness direction of the sheet is called the TD (transverse direction), the bending workability expressed as the ratio of minimum bending radius R to thickness t in a 90° W bend test should preferably be 1.0 or less, preferably 0.5 or less, in both the LD and TD. Further, in order to improve the shape and dimensional accuracy of the bent product, the LD post-notching bending workability expressed as R/t should preferably be 0. The post-notching bending workability is determined by the method explained in the Examples set out below. The "LD bending workability" is the bending workability evaluated for a bending workability test piece cut so that its longer direction corresponds to the LD, with bending performed around an axis lying in the TD. The "TD bending workability" is the bending workability evaluated for a bending workability test piece cut so that its longer direction corresponds to the TD, with bending performed around an axis lying in the LD.

The TD value of the stress relaxation resistance property is especially important in vehicle-mounted connectors and similar applications. Stress relaxation property is therefore preferably evaluated as stress relaxation rate using a test piece whose longer direction corresponds to the TD. The stress relaxation rate measured for a test piece held at 150° C. for 1000 hours with the maximum load stress on the sheet surface at 80% of 0.2% yield strength is preferably 5% or less, more preferably 3% or less.

Manufacturing Method

The foregoing copper alloy sheet material according to the invention can, for example, be manufactured by the production processes set out below.

Melting/Casting→Hot rolling→Cold rolling→Solution heat treatment→Intermediate cold rolling→Aging treatment→Finish cold rolling→Low-temperature annealing.

It is, however, necessary to introduce refinements into some of the processes as explained in the following. Although not included in the production processes enumerated above, hot rolling can be followed by optional facing, and heat treatment can be followed by optional pickling, polishing and degreasing. The processes will now be explained individually.

Melting/Casting

Melting/casting can be done in accordance with the ordinary copper alloy casting method. The slab can be produced by continuous casting, semi-continuous casting or the like.

Hot Rolling

To avoid generation of precipitates in the course of rolling, Cu—Ni—Si-based copper alloy hot rolling is usually conducted by the method of rolling in a high-temperature range of 700° C. or greater or 750° C. or greater followed by quenching upon completion of the rolling. However, a copper alloy sheet material having the unique texture of the present invention is difficult, if not impossible, to manufacture under these commonly accepted hot rolling conditions. More specifically, the inventors conducted an investigation in which the inventors varied the conditions in the processes following the hot rolling under such conditions over broad ranges but were unable to find conditions that enabled manufacture of a copper alloy sheet material having the {420} plane as its main orientation direction with good reproducibility. The inventors therefore carried out a further thorough study through which the inventors discovered the hot rolling conditions of the present invention, namely, the conditions of conducting a first pass in a temperature range of 950° C.-700° C. and conducting rolling in a temperature range of less than 700° C. to 400° C. at a reduction ratio of 40% or greater.

When the slab is hot-rolled, the first rolling pass in a temperature range above 700° C., in which recrystallization readily occurs, breaks down the cast structure and makes the composition and texture uniform. However, rolling at a high temperature exceeding 950° C. is undesirable because it is liable to cause cracking at portions where the alloying components have segregated and other portions where the melting point has dropped. In order to ensure that total recrystallization occurs during the hot rolling process, it is highly effective to conduct rolling in the temperature range of 950° C.-700° C. at a rolling reduction ratio of 60% or greater. This helps to make the texture still more uniform. However, a large rolling load is required to achieve a reduction of 60% in a single pass and it is acceptable to bring the total reduction up to 60% or greater by dividing the rolling into multiple passes. In the present invention it is also important to achieve a rolling reduction ratio of 40% or greater in the less than 700° C. to 400° C. temperature range in which rolling strain readily occurs. The formation of some precipitates in this way and the combination of the cold rolling and the solution heat treatment in the ensuing processes facilitates formation of a recrystallization texture whose main orientation component is the {420} plane. At this time, too, a number of rolling passes can be conducted in the less than 700° C. to 400° C. temperature range. It is more effective to conduct the final pass in the hot rolling at a temperature of 600° C. or less. The total reduction in the hot rolling should be made about 80% to 95%.

The reduction ratio $\epsilon$ (%) in the respective temperature ranges is calculated using the Expression (3), $$\epsilon=(t_0-t_1)/t_0\times 100 \quad (3).$$

Assume, for example, that the thickness of the slab subjected to the first rolling pass conducted between 950° C. and 700° C. is 120 mm, rolling is conducted in the temperature range of 700° C. or greater (it is acceptable to return the slab to the furnace for reheating), the sheet thickness upon completion of the final rolling pass conducted in the temperature range of 700° C. or greater is 30 mm, and rolling is continued with the final hot rolling pass being conducted in the range of less than 700° C. to 400° C. to obtain a hot-rolled sheet of a final thickness of 10 mm. In this case, the reduction ratio in the rolling conducted in the temperature range of 950° C.-700° C. calculated from Expression (3) is (120−30)/120×100=75 (%). The reduction ratio in the temperature range of less than 700° C. to 400° C. calculated from Expression (3) is (30−10)/30×100=66.7 (%).

Cold Rolling

During rolling of the hot-rolled sheet, it is important in the cold rolling conducted before solution heat treatment to achieve a reduction ratio of 85% or greater, preferably 90% or greater. By conducting the solution heat treatment of the next step on the sheet processed at such a high reduction ratio, there can be formed a recrystallization texture whose main orientation component is the {420} plane. The recrystallized texture is highly dependent on the cold rolling reduction ratio before recrystallization. Specifically, occurrence of crystal orientation whose main orientation component is the {420} plane is substantially nil when the cold rolling reduction ratio is 60% or less, gradually increases with increasing reduction ratio in the range of approximately 60% to 80%, and rises sharply when the cold rolling reduction ratio exceeds 80%. In order to obtain a crystal orientation strongly dominated by the {420} orientation, it is necessary to ensure a cold rolling reduction ratio of 85% or greater, and a ratio of 90% or greater is preferable. The upper limit of the cold rolling reduction ratio need not be specially defined because the maximum ratio achievable is automatically determined by the mill power and the like. However, good results are easier to obtain at a reduction ratio of around 98% or less, owing to avoidance of edge cracking and the like.

In the present invention, no intermediate annealing is inserted into the cold rolling passes after the hot rolling and before the solution heat treatment. If intermediate annealing should be conducted after the hot rolling and before the solution heat treatment, the recrystallization texture whose main orientation component is the {420} plane formed by the solution heat treatment would be extremely weak.

Solution Heat Treatment

Although conventional solution heat treatment is aimed mainly at returning solute elements to solid solution in the matrix and recrystallization, another important aim in the present invention is to form the recrystallization texture whose main orientation component is the {420} plane. The solution heat treatment is preferably conducted at a furnace temperature of 700° C.-850° C. When the temperature is too low, the recrystallization is incomplete and entry of the solute elements into solid solution is insufficient. When the temperature is too high, the crystal grains become coarse. In either case, it becomes difficult to finally obtain a high-strength material excellent in bending workability. Moreover, rapidly increasing the temperature to 700° C. was found to be highly effective for increasing the {420} orientation density. When the temperature increase rate is slow, recovery and precipitation occur while the temperature is rising. This slows the progress of recrystallization and is disadvantageous for generating {420} orientation. To be specific, the heating time from 100° C. to 700° C. is preferably made 20 sec or less, more preferably 15 sec or less.

In the solution heat treatment, the heat treatment is preferably carried out with the holding time and ultimate attaining temperature in the range of 700° C. to 850° C. set so that the average grain diameter of the recrystallization grains (twin boundaries not considered crystal boundaries) becomes 10 μm-60 μm, more preferably 15 μm-40 μm. When the recrystallization grains are too fine, the recrystallization texture whose main orientation component is the {420} plane becomes weak. Excessively fine recrystallization grains are also disadvantageous from the viewpoint of improving stress relaxation resistance property. When the recrystallization grains are too coarse, surface roughness tends to occur at bends. The recrystallization grain diameter varies depending on the cold rolling reduction ratio before the solution heat treatment and chemical composition. Nevertheless, the holding time and ultimate attaining temperature can be set within the range of 700° C. to 850° C. based on the results of experiments conducted for the alloy concerned to determine the relationship between the solution heat treatment heating pattern and the average crystal grain diameter. In the case of an alloy of a chemical composition defined by the present invention, suitable conditions can be set within the heating conditions of a temperature of 700° C. to 850° C. and a holding time of 10 sec to 10 min.

Intermediate Cold Rolling

Next, cold rolling can be conducted at a reduction ratio of 50% or less. The cold rolling at this stage has an effect of promoting precipitation in the ensuing aging treatment process, thereby making it possible to shorten the aging time for bringing out the required properties (conductivity, hardness). Although this cold rolling develops texture whose main orientation component is the {220} plane, crystal grains whose {420} plane lies parallel to the sheet surface remain sufficiently at a cold rolling reduction rate in the range of 50% or less. The cold rolling at this stage must be conducted at a reduction ratio of 50% or less and is preferably conducted at a reduction ratio between 0 and 35%. When the reduction ratio is too high, precipitation in the following aging treatment becomes uneven and overaging is apt to occur. Moreover, realization of an ideal crystal orientation satisfying Expression (1) becomes difficult. To say that the reduction ratio is zero means that no intermediate cold rolling after solution heat treatment is conducted and the processing proceeds directly to the aging treatment. In the production of the copper alloy sheet material of the present invention, it is acceptable to omit the cold rolling step at this stage in order to improve productivity.

Aging Treatment

Next, aging treatment is carried out. The aging treatment is conducted under conditions favorable for improving the conductivity and strength of the alloy, and is carried out without increasing the temperature very much. When the aging treatment temperature is too high, crystal orientation dominated by the {420} orientation developed by the solution heat treatment is weakened, with the result that a sufficient bending workability improvement effect may not be obtained. To be specific, the aging treatment is preferably conducted so that the sheet temperature becomes 400° C.-500° C., more preferably 420° C.-480° C. Good results can be obtained at an aging treatment time of around 1 h to 10 h.

Finish Cold Rolling

This cold rolling is for further improving the strength level. However, rolled texture whose main orientation component is the {220} plane develops with increase in the cold rolling reduction rate. When the reduction ratio is too high, the relative dominance of rolled texture with {220} orientation becomes excessive and realization of a crystal orientation whose strength and bending workability are both at high levels becomes impossible. An exhaustive study carried out by the inventors revealed that the finish cold rolling should preferably be carried out in a reduction ratio range not exceeding 50%. A reduction ratio in this range makes it possible to maintain a crystal orientation that satisfies Expression (1). As with the foregoing intermediate cold rolling, this finish cold rolling is not absolutely necessary.

The final sheet thickness is defined as about 0.05 mm-1.0 mm, preferably 0.08 mm-0.5 mm.

Low-temperature Annealing

Low-temperature annealing can be implemented after the finish cold rolling for the purpose of enhancing bending workability through reduction of sheet residual stress and enhancing stress relaxation resistance property through reduction of voids and dislocation at the slip plane. The heating temperature is preferably set to make the sheet temperature 150° C.-550° C. Annealing under this temperature condition enables improvement of bending workability and stress relaxation resistance property with substantially no strength decrease. It also has a conductivity enhancing effect. When the heating temperature is too high, the sheet softens in a short time to make property variance likely to occur in both the batch and continuous systems. When the heating temperature is too low, the property improvement effect cannot be fully obtained. The holding time at the temperature should preferably be 5 sec or greater, with good results usually being obtained within 1 h. When the finish cold rolling is not conducted, the low-temperature annealing should be omitted.

EXAMPLES

Molten copper alloys produced to have the compositions shown in Table 1 were cast using a vertical continuous casting machine. In all but some Comparative Examples, samples of 50-mm thickness were cut from the obtained slabs (thickness: 180 mm). The samples were heated to 950° C. and then extracted, whereafter hot rolling was begun. The pass schedule at this time was, except in some Comparative Examples, established to conduct rolling at a reduction ratio of 60% or greater in the 950° C.-700° C. temperature range and also conduct rolling in the temperature range of less than 700° C. Except in some Comparative Examples, the final pass temperature of the hot rolling was between 600° C. and 400° C. The total hot rolling reduction ratio starting from the slab was about 90%. After the hot rolling, the oxidized surface layer was removed by machine polishing (facing). Next, cold rolling was carried out at one of various reduction ratios, whereafter each sample was subjected to solution heat treatment. Temperature change during solution heat treatment was monitored with a thermocouple attached to the sample surface and the heating time between 100° C. and 700° C. in the heating process was determined. Except in some Comparative Examples, the average grain diameter (twin boundaries not considered crystal boundaries) of the recrystallization grains after the solution heat treatment was made to fall between 10 μm and 60 μm by, with consideration to the alloy composition, adjusting the ultimate attaining temperature to within the range of 700° C.-850° C. and adjusting the holding time in the range of 700° C.-850° C. to within the range of 10 sec-10 min. Next, except in some Examples, the sheet following solution heat treatment was subjected to intermediate cold rolling at one of various reduction ratios, followed by aging treatment. The aging treatment temperature was made a sheet temperature of 450° C., and the aging time was adjusted with consideration to the alloy composition so that hardness peaked with 450° C. aging. These optimum solution heat treatment conditions and aging treatment times for the alloy compositions were known from tests carried out beforehand. Next, except in some Examples, finish cold rolling was conducted at various rolling reduction ratios. The samples that were subjected to the finish cold rolling were thereafter further low-temperature annealed by charging into a 400° C. furnace for 5 min. Test specimens were obtained in the foregoing manner. The test specimens were faced in the course of preparation as required to make their thickness a constant 0.2 mm. Main conditions for producing the specimens are shown in Table 2.

In some Comparative Examples (Nos. 21, 22, 24 and 25), an ordinary manufacturing method was used, in which intermediate annealing was conducted at 550° C. for 3 hr at the point where the sheet thickness reduction reached 50% in the cold rolling after the hot rolling and before the solution heat treatment.

A commercially available Cu—Ni—Si-based copper alloy (C7025, 0.2-mm thickness) was acquired and included among the test specimens (No. 34).

TABLE 1

| | Chemical composition (mass %) | | | |
|---|---|---|---|---|
| No. | Cu | Ni | Si | Other |
| 1 | Balance | 1.82 | 0.46 | — |
| 2 | Balance | 2.52 | 0.54 | — |
| 3 | Balance | 3.74 | 0.85 | — |
| 4 | Balance | 1.76 | 0.44 | Sn: 0.54, Zn: 0.44 |
| 5 | Balance | 2.53 | 0.52 | Mg: 0.15 |
| 6 | Balance | 1.34 | 0.43 | Co: 1.05 |
| 7 | Balance | 2.82 | 0.68 | Sn: 0.51, Zn: 0.48 |
| 8 | Balance | 2.62 | 0.69 | Cr: 0.11, P: 0.09 |
| 9 | Balance | 2.46 | 0.48 | Ti: 0.10, B: 0.007 |
| 10 | Balance | 2.83 | 0.71 | Mn: 0.07, V: 0.14 |
| 11 | Balance | 3.89 | 0.88 | Zr: 0.12 |
| 12 | Balance | 4.15 | 1.00 | — |
| 13 | Balance | 1.56 | 0.39 | — |
| 14 | Balance | 0.78 | 0.21 | — |
| 15 | Balance | 1.65 | 0.43 | Sn: 0.46, Zn: 0.24, Fe: 0.35 |
| 16 | Balance | 2.08 | 0.51 | Fe: 0.24, P: 0.12 |
| 21 | Balance | 1.82 | 0.46 | — |
| 22 | Balance | 2.52 | 0.54 | — |
| 23 | Balance | 3.74 | 0.85 | — |
| 24 | Balance | 1.76 | 0.44. | Sn: 0.54, Zn: 0.44 |
| 25 | Balance | 1.76 | 0.44 | Sn: 0.54, Zn: 0.44 |
| 26 | Balance | 0.38 | 0.09 | Sn: 0.84, Zn: 0.18 |
| 27 | Balance | 5.64 | 1.30 | — |
| 28 | Balance | 1.76 | 0.44 | Sn: 0.54, Zn: 0.44 |
| 29 | Balance | 1.76 | 0.44 | Sn: 0.54, Zn: 0.44 |
| 30 | Balance | 1.76 | 0.44 | Sn: 0.54, Zn: 0.44 |
| 31 | Balance | 1.76 | 0.44 | Sn: 0.54, Zn: 0.44 |
| 32 | Balance | 1.76 | 0.44 | Sn: 0.54, Zn: 0.44 |

TABLE 1-continued

| | Chemical composition (mass %) | | | |
|---|---|---|---|---|
| No. | Cu | Ni | Si | Other |
| 33 | Balance | 1.76 | 0.44 | Sn: 0.54, Zn: 0.44 |
| 34 | Balance | 2.56 | 0.56 | Mg: 0.16 |

Remark: Underlining indicates value outside invention range.

Samples taken from test specimens were examined by the methods set out below for crystal grain texture, X-ray diffraction intensity, conductivity, tensile strength, stress relaxation rate, ordinary bending workability, and post-notching bending workability. Some test specimens were further examined for crystal orientation by the electron backscatter diffraction pattern (EBSP) method.

Crystal Grain Texture

After the surface (rolled surface) of the test specimen was polished and etched, the surface thereof was observed with an optical microscope and the average crystal grain diameter was measured by the cutting method of JIS H 0501.

X-ray Diffraction Intensity

A polish-finished sample prepared by polishing the surface (rolled surface) of the test specimen with #1500 waterproof sandpaper was measured at the polish-finished surface for reflection surface x-ray diffraction integral intensity of the {420} plane and {220} plane using an x-ray diffractometer (XRD) under conditions of Mo—Kα radiation, tube voltage of 20 kV, and tube current of 2 mA. The X-ray diffraction integral intensity from the {420} plane and {220} plane of standard pure copper powder was also measured using the same XRD under the same measurement conditions. The measured values were used to calculate the X-ray diffraction intensity ratio $I\{420\}/I_0\{420\}$ in Expression (1) and the X-ray diffraction intensity ratio $I\{220\}/I_0\{220\}$ in Expression (2).

Conductivity

The conductivity of each test specimen was measured in accordance with JIS H 0505

Tensile Strength

LD tensile strength test pieces (JIS No. 5) were taken from each test specimen, a tensile strength test was conducted in compliance with JIS Z 2241 for n=3 and the average value for n=3 was defined as the tensile strength.

Stress Relaxation Property

A bending test piece (width: 10 mm) was taken from each test specimen so that its longer direction corresponded to the TD and was fastened to have an arch-like bend such that the magnitude of the surface stress of the middle portion in the longer direction of the test piece became 80% of the 0.2% yield strength. The surface stress is defined by the equation $$\text{Surface stress(MPa)}=6Et\delta/L_0^2,$$

where

E: elastic modulus t: test piece thickness

δ: test piece flex height.

After the test piece had been held in this condition for 1000 h in a 150° C. atmosphere, the stress relaxation rate was calculated from the warp using the following equation $$\text{Stress relaxation rate(\%)}=(L_1-L_2)/(L_1-L_0)\times 100,$$

where $L_0$: jig length, i.e., horizontal distance (mm) between the ends of the fastened test piece during the test $L_1$: test piece length (mm) at start of test $L_2$: horizontal distance (mm) between the ends of the test piece after the test.

A stress relaxation rate of 5% or less was evaluated to have high durability for vehicle-mounted connector applications and judged acceptable.

Ordinary Bending Workability

LD bending test pieces and TD bending test pieces (each 10 mm in width) were taken from each test specimen so that their longer directions corresponded to the LD and the TD, respectively, and were subjected to 90° W bend testing in compliance with JIS H 3110. The surfaces and cross-sections at the bends of the test pieces after testing were observed with an optical microscope at a magnification of 100× to determine the smallest bending radii R at which cracking did not occur and these values were divided by the thickness t of the test specimen to determine the R/t values for the LD and the TD. The LD and TD tests of each test specimen were both done for n=3 and the performance of the test piece among n=3 that gave the worst result was used to represent the R/t value. A test specimen whose R/t values for both the LD and TD were 0.5 or less was judged acceptable.

Post-notching Bending Workability

Figure 4:
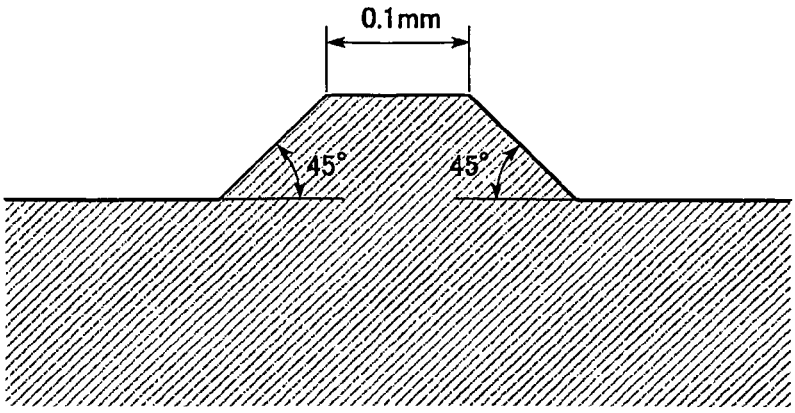
FIG. 4 is a diagram showing the cross-sectional shape of a notch-forming jig.
Figure 5:
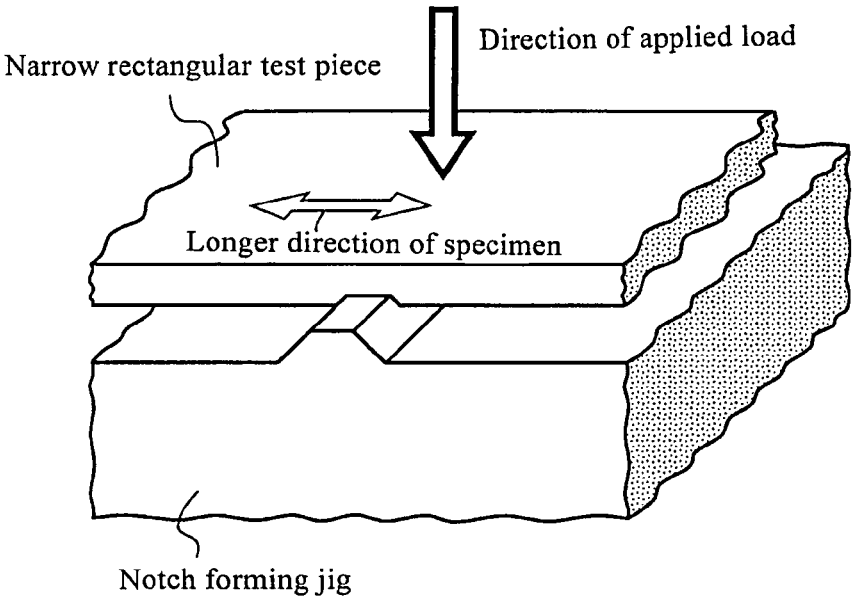
FIG. 5 is a diagram illustrating a notching method.
Figure 6:
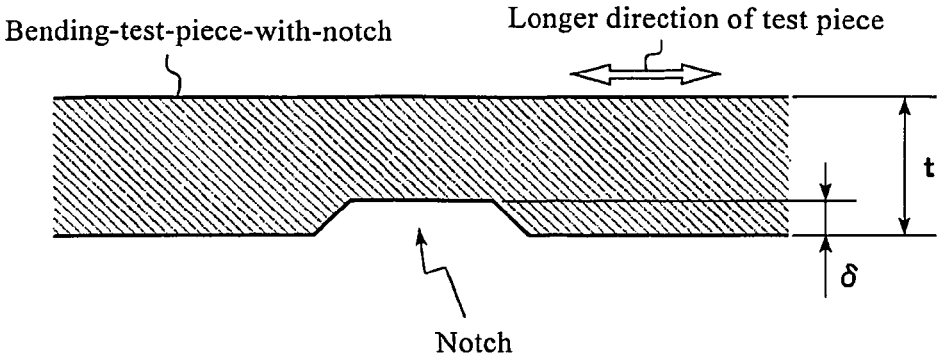
FIG. 6 is a diagram schematically illustrating the cross-sectional shape in the vicinity of a notched region of a bending-test-piece-with-notch.

A narrow rectangular test piece (width: 10 mm) taken from each test specimen so that its longer direction corresponded to the LD was formed with a notch extending across its full width by using a notch forming jig of the cross-sectional shape shown in FIG. 4 (width of flat face at tip of protrusion: 0.1 mm, side face angles: 450) and applying a load of 10 kN as shown in FIG. 5. The notch direction (i.e., the direction parallel to the groove) was perpendicular to the longer direction of the test piece. The depth of the notch of the bending-test-piece-with-notch prepared in this manner was measured and the notch depth δ, illustrated schematically in FIG. 6, was found to be about ¼ to ⅙ the thickness t.

A notch bending test was carried out on each bending-test-piece-with-notch by subjecting it to a notch 90° W bend test in compliance with JIS H 3110. At this time, a jig was used in which the R of the center protrusion tip of the lower die was 0 mm, and the 90° W bend test was conducted with the bending-test-piece-with-notch placed with its notched surface facing downward and set so that the center protrusion tip aligned with the notch.

The surface and cross-section at the bend of the test piece after testing were observed with an optical microscope at a magnification of 100× to check for cracking. A rating of G (good) was assigned when no cracking was found and a rating of P (poor) was assigned when cracking was observed. Breakage at the bend was indicated by R (rupture).

The test of each test specimen was done for n=3 and the performance of the test piece among n=3 that gave the worst result was rated G, P or R. A test specimen rated G was judged acceptable.

EBSP Measurement

EBSP refers to the Electron Back-Scatter Diffraction Pattern method. An electron beam is projected onto individual grains of the specimen and the orientation of the individual crystals is determined from the electron diffraction pattern. The final finishing of the specimen surface was done by vibration polishing (a polishing method that does not introduce strain). The crystal orientations determined by EBSP were used to calculate the percentage of surface area accounted for by crystals having the {120} plane in parallel with the sheet surface (rolled surface). Crystals whose direction perpendicular to the sheet surface (ND) was within 10° of the <120> direction were deemed to be "crystals having the {120} plane in parallel with the sheet surface" and the percentage of the surface area accounted for by these crystals was called the "{120} orientation ratio by EBSP." The ratio is preferably 20% or greater, more preferably 25% or greater.

The foregoing results are presented in Table 2. In the Ordinary bending workability, Post-notching bending workability, and Stress relaxation rate columns of Table 2, LD and TD mean the longer direction of the test piece.

TABLE 2

| | | Manufacturing conditions | | | | | Texture | | |
|---|---|---|---|---|---|---|---|---|---|
| | | Under 700° C. to 400° C. Hot rolling reduction | Cold rolling reduction: Before solution heat treatment | Cold rolling reduction: Intermediate | Cold rolling reduction: Finish | Time from 100° C. to 700° C. | Ave crystal grain diameter | Ratio of X-ray diffraction intensity | |
| Examples | No. | (%) | (%) | (%) | (%) | (sec) | (μm) | $I\{420\}/I_0\{420\}$ in Expression (1) | $I\{220\}/I_0\{220\}$ in Expression (2) |
| Invention | 1 | 56 | 92 | 20 | 30 | 10 | 22 | 2.2 | 2.4 |
| | 2 | 49 | 89 | 0 | 25 | 10 | 19 | 2.6 | 2.1 |
| | 3 | 42 | 86 | 10 | 10 | 10 | 16 | 2.8 | 1.7 |
| | 4 | 47 | 97 | 0 | 30 | 8 | 20 | 2.3 | 2.5 |
| | 5 | 43 | 93 | 0 | 0 | 11 | 18 | 3.4 | 0.9 |
| | 6 | 52 | 87 | 15 | 15 | 10 | 15 | 2.4 | 2.0 |
| | 7 | 42 | 86 | 30 | 0 | 9 | 16 | 2.7 | 2.2 |
| | 8 | 45 | 90 | 0 | 20 | 11 | 18 | 2.6 | 1.9 |
| | 9 | 52 | 94 | 20 | 15 | 10 | 26 | 2.5 | 2.3 |
| | 10 | 46 | 91 | 30 | 0 | 9 | 16 | 2.7 | 1.8 |
| | 11 | 42 | 86 | 0 | 12 | 9 | 12 | 2.3 | 1.9 |
| | 12 | 40 | 85 | 0 | 15 | 10 | 15 | 2.5 | 1.6 |
| | 13 | 50 | 92 | 0 | 40 | 9 | 18 | 2.3 | 2.4 |
| | 14 | 45 | 95 | 0 | 48 | 10 | 16 | 2.1 | 2.8 |
| | 15 | 50 | 94 | 0 | 35 | 10 | 14 | 2.1 | 1.8 |
| | 16 | 45 | 90 | 10 | 20 | 10 | 19 | 2.2 | 2.0 |
| Comparative | 21 | 17 | 90 (*1) | 20 | 30 | 10 | 8 | 0.5 | 3.6 |
| | 22 | 0 (*2) | 90 (*1) | 30 | 15 | 10 | 6 | 0.3 | 3.1 |
| | 23 | 20 | 70 | 50 | 0 | 10 | 4 | 0.2 | 3.3 |
| | 24 | 24 | 90 (*1) | 0 | 35 | 15 | 12 | 0.8 | 3.2 |
| | 25 | 24 | 90 (*1) | 0 | 15 | 35 | 12 | 0.6 | 3.7 |
| | 26 | 46 | 94 | 30 | 45 | 10 | 16 | 0.4 | 2.4 |
| | 27 | 44 | 90 | 20 | 10 | 10 | 3 | 0.6 | 2.0 |

TABLE 2-continued

| | | | | | | | | |
|---|---|---|---|---|---|---|---|---|
| 28 | 47 | 97 | 0 | 30 | 8 | 85 | 2.1 | 2.7 |
| 29 | 47 | 97 | 0 | 30 | 8 | Mixed | 0.3 | 5.5 |
| 30 | 47 | 97 | 0 | 30 | 45 | 18 | 0.9 | 3.5 |
| 31 | 47 | 97 | 0 | 30 | 8 | 3 | 0.7 | 3.3 |
| 32 | 47 | 97 | 0 | 65 | 8 | 20 | 0.8 | 4.1 |
| 33 | 47 | 97 | 70 | 30 | 8 | 20 | 0.6 | 5.7 |
| 34 | — | — | — | — | — | 8 | 0.4 | 2.3 |

| | | Texture | Properties | | | | | |
|---|---|---|---|---|---|---|---|---|
| | | {120} orientation ratio by EBSP | Conductivity | Tensile strength | Ordinary bending workability (R/t) | | Post-notching bending workability | Stress relaxation rate (%) |
| Examples | No. | (%) | (% IACS) | (Mpa) | LD | TD | LD | TD |
| Invention | 1 | 29 | 47.2 | 742 | 0.0 | 0.0 | G | 4.1 |
| | 2 | 33 | 45.5 | 763 | 0.0 | 0.0 | G | 3.8 |
| | 3 | 34 | 40.6 | 794 | 0.0 | 0.3 | G | 2.9 |
| | 4 | 32 | 40.3 | 756 | 0.0 | 0.0 | G | 3.9 |
| | 5 | 47 | 45.6 | 724 | 0.0 | 0.0 | G | 2.6 |
| | 6 | | 50.8 | 784 | 0.0 | 0.3 | G | 3.5 |
| | 7 | | 40.2 | 728 | 0.0 | 0.0 | G | 3.6 |
| | 8 | | 43.6 | 774 | 0.0 | 0.0 | G | 3.4 |
| | 9 | | 44.8 | 768 | 0.0 | 0.3 | G | 3.5 |
| | 10 | | 40.2 | 736 | 0.0 | 0.0 | G | 3.6 |
| | 11 | | 40.1 | 808 | 0.0 | 0.5 | G | 4.4 |
| | 12 | | 40.1 | 778 | 0.0 | 0.5 | G | 3.2 |
| | 13 | | 43.2 | 756 | 0.0 | 0.5 | G | 3.8 |
| | 14 | | 50.5 | 712 | 0.0 | 0.3 | G | 4.4 |
| | 15 | | 41.5 | 742 | 0.0 | 0.0 | G | 4.1 |
| | 16 | | 40.6 | 734 | 0.0 | 0.0 | G | 4.0 |
| Comparative | 21 | 9 | 47.8 | 677 | 0.5 | 0.3 | P | 7.4 |
| | 22 | 5 | 45.4 | 708 | 1.0 | 1.0 | R | 6.6 |
| | 23 | 3 | 41.5 | 729 | 1.5 | 1.5 | R | 6.4 |
| | 24 | | 39.8 | 656 | 0.5 | 0.0 | P | 6.4 |
| | 25 | | 39.6 | 697 | 1.0 | 2.5 | R | 6.8 |
| | 26 | 6 | 55.5 | 612 | 0.5 | 1.5 | P | 7.2 |
| | 27 | 8 | 32.1 | 822 | 2.0 | 3.5 | P | 8.3 |
| | 28 | | 39.6 | 759 | 0.0 | 1.5 | P | 2.9 |
| | 29 | | 44.3 | 676 | 0.5 | 4.2 | R | 9.6 |
| | 30 | | 41.3 | 734 | 1.0 | 1.5 | P | 4.9 |
| | 31 | | 40.9 | 736 | 0.0 | 1.0 | P | 7.9 |
| | 32 | | 39.3 | 816 | 1.0 | 2.5 | P | 5.8 |
| | 33 | | 41.6 | 777 | 1.5 | 1.0 | P | 5.2 |
| | 34 | | 44.6 | 727 | 2.0 | 1.5 | R | 5.4 |

Remark:
Underlining indicates value outside invention range,.
(*1): 550° C. × 3 h intermediate annealing was conducted between cold rolling passes totaling 90% reduction.
(*2): Signifies that the final hot rolling pass temperature was 700° C. or greater.

As seen in Table 2, all invention Example specimens had crystal orientation satisfying Expression (1), exhibited conductivity of 35% IACS or greater and high strength, namely tensile strength of 700 MPa or greater, and had excellent bending workability, namely, R/t values in both the LD and TD of 0.5 or less. Moreover, as regards post-notching bending workability in the LD direction, which is of particular practical importance, no cracking occurred despite severe bending at R/t=0 in the 90° W bending test. In addition, the specimens concomitantly exhibited an excellent TD stress relaxation rate, a property of particular importance in vehicle-mounted connectors and similar applications, of 5% or less. Possession of crystal orientation with the main orientation component in the {420} plane was also affirmed from the percentage of {120} orientation measured by the EBSP method.

In contrast, the specimens of Comparative Examples No. 21 to No. 25 were manufactured from the same alloys as those of Invention Examples No. 1 to No. 4 by conventional processes (including, for example, some in which the hot rolling final pass temperature was made 650° C. or greater or 700° C. or greater, and some in which an intermediate annealing step was interposed at a point after hot rolling and before solution heat treatment). In all of these specimens, the X-ray diffraction intensity of the {420} crystal plane was weak, and tradeoffs were seen between strength and bending workability or between bending workability and stress relaxation resistance property. And it will also be noted that the specimens were particularly inferior in post-notching bending workability.

In Comparative Examples No. 26 and No. 27, good properties were not obtained because the Ni and Si contents fell outside the prescribed ranges. In No. 26, insufficient Ni and Si contents resulted in a low degree of precipitation, so that the strength level was low and stress relaxation resistance property did not improve even though Mg was added. Moreover, since almost no precipitation occurred in stages after the hot rolling, the crystal orientation having the {420} plane as it main orientation component was weak even when the reduction ratio in the ensuing cold rolling was made 90% or greater, and the post-notching bending workability showed no improvement even though the strength level was low. In No. 27, excessive Ni and Si contents made it impossible to set a suitable solution heat treatment temperature. As a result, the average crystal grain diameter was small and the crystal orientation having the {420} plane as it main orientation component was weak, so that tensile strength was high but bending workability and stress relaxation resistance property were inferior.

In Comparative Examples No. 28 to No. 31, good properties were not obtained because the solution heat treatment conditions fell outside the prescribed ranges. In No. 28, good bending workability could not be obtained because the excessively high solution heat treatment temperature of 870° C. coarsened the crystal grains. In No. 29, tensile strength, bending workability and stress relaxation resistance property were all inferior because the excessively low solution heat treatment temperature of 650° C. did not allow the recrystallization to progress thoroughly, so that a mixed grain structure resulted. In No. 30, the slow temperature increase rate during solution heat treatment led to the occurrence of recovery that released some distortion/strain, with the result that the crystal orientation having the {420} as the main orientation component was weak and bending workability inferior. No. 31 is an example in which the hold temperature during solution heat treatment was regulated to refine the average crystal grain diameter to around 3 μm and thereby improve bending workability. In this case, bending workability improved but stress relaxation resistance property was degraded because the crystal grains became fine.

In Comparative Examples No. 32 and No. 33, good properties were not obtained because the intermediate rolling reduction ratio or the finish cold rolling ratio exceeded the prescribed upper limit. In No. 32, strength was high but bending workability was very poor because the finish cold rolling reduction ratio was too high. In No. 33, the finish cold rolling reduction ratio was not high but the intermediate cold rolling reduction ratio was too high, so that the crystal orientation having the {420} as the main orientation component was weak and good properties could not be obtained.

Comparative Example No. 34 was a commercially available product (C7025) considered to have excellent bending workability and stress relaxation resistance property. A comparison with Invention Example No. 5 of substantially the same composition shows it to be inferior in both bending workability and stress relaxation resistance property.

Figure 2:
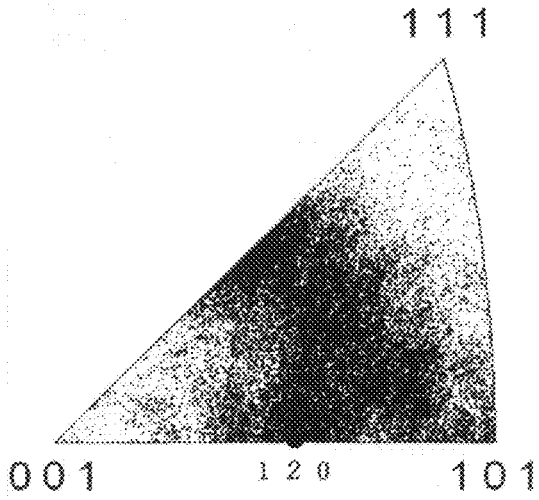
FIG. 2 is an inverse pole figure showing orientation distribution in the sheet plane direction measured by the EBSP method in an Invention Example (No. 1).
Figure 3:
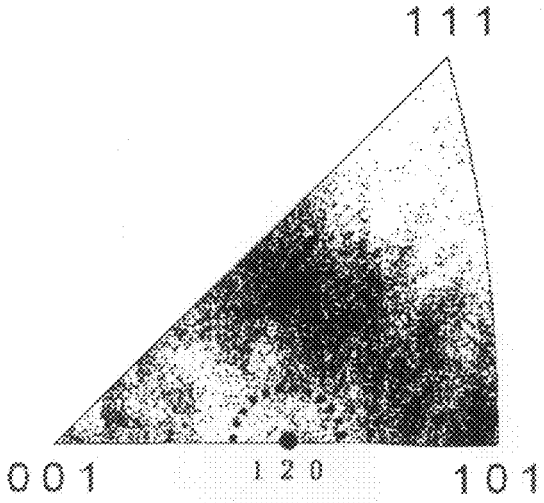
FIG. 3 is an inverse pole figure showing orientation distribution in the sheet plane direction measured by the EBSP method in a Comparative Example (No. 21).

FIGS. 2 and 3 are inverse pole figures showing the orientation distribution in the sheet plane direction measured by the EBSP method in an Invention Example (No. 1) and a Comparative Example (No. 21), respectively. The dotted lines in the figures indicate the range of crystal orientation within 10° of the {120} crystal plane. The {120} crystal plane concentration is clearly higher in the Invention Example (FIG. 2) than in the Comparative Example (FIG. 3). It can also be seen that in the Invention Example (FIG. 2) the crystal orientation in the sheet surface direction is distributed in a direction whose Schmid factor is very high (see FIG. 1). This is considered to be the reason for the marked improvement in bending workability (particularly post-notching bending workability).

Figure 7:
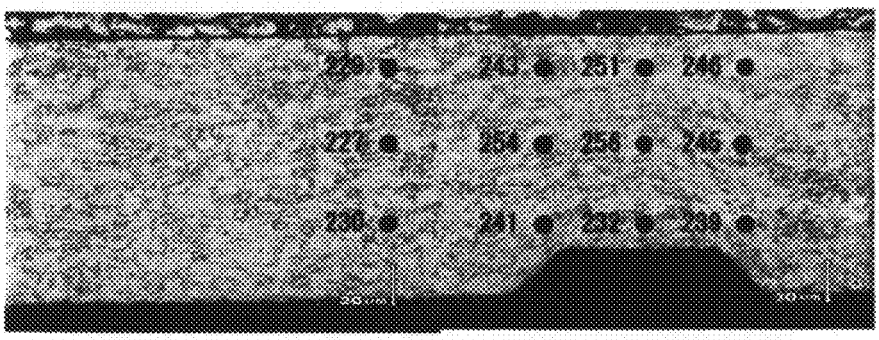
FIG. 7 is a photograph of a cross-section taken in Comparative Example No. 22 showing Vickers hardness distribution in the cross-section after notching.
Figure 8:
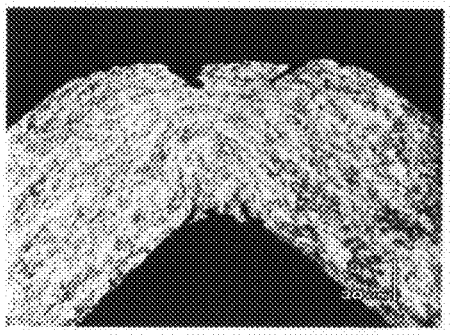
FIG. 8 is a cross-sectional photograph showing the specimen of FIG. 7 after bending.

FIG. 7 is a photograph of a cross-section taken in Comparative Example No. 22 showing Vickers hardness distribution in the cross-section after notching. Work-hardening is present in the portion of the sheet thinned by notching. FIG. 8 is a cross-sectional photograph showing the specimen after bending. The state of the cracking that occurred can be seen.

What is claimed is:

1. A copper alloy sheet material comprising, in mass %, Ni: 0.7%-4.2%, Si: 0.2%-1.0%, and the balance substantially of Cu, and having a crystal orientation satisfying Expression (1):

$$I\{420\}/I_0\{420\}>1.5 \quad (1),$$

where I{420} is the X-ray diffraction intensity from the {420} crystal plane in the sheet plane of the copper alloy sheet material and $I_0\{420\}$ is the X-ray diffraction intensity from the {420} crystal plane of standard pure copper powder.

2. The copper alloy sheet material according to claim 1, further having a crystal orientation satisfying Expression (2):

$$I\{220\}/I_0\{220\}\leq 3.0 \quad (2),$$

where I{220} is the X-ray diffraction intensity from the {220} crystal plane in the sheet plane of the copper alloy sheet material and $I_0\{220\}$ is the X-ray diffraction intensity from the {220} crystal plane of standard pure copper powder.

3. The copper alloy sheet material according to claim 1 having an average crystal grain diameter of 10 μm-60 μm.

4. The copper alloy sheet material according to claim 1, further comprising one or more of Sn: 1.2% or less, Zn: 2.0% or less, Mg: 1.0% or less, Co: 2.0% or less, and Fe: 1.0% or less.

5. The copper alloy sheet material according to claim 1, further comprising a total of 3% or less of one or more of Cr, B, P, Zr, Ti, Mn and V.

6. A method of manufacturing the copper alloy sheet of claim 1 that comprises:

successively conducting the steps of hot rolling at 950° C.-400° C., cold rolling at a reduction ratio of 85% or greater, solution heat treatment at 700° C.-850° C., intermediate cold rolling at a reduction ratio of 0%-50%, aging at 400° C.-500° C., and finish cold rolling at a reduction ratio of 0%-50%, in the hot rolling step of which method a first pass is conducted in a temperature range of 950° C.-700° C. and rolling is conducted in a temperature range of less than 700° C. to 400° C. at a reduction ratio of 40% or greater.

7. The method of manufacturing the copper alloy sheet according to claim 6, in the hot rolling step of which rolling is conducted in a temperature range of 950° C.-700° C. at a reduction ratio of 60% or greater, and rolling is conducted in a temperature range of less than 700° C. to 400° C. at a reduction ratio of 40% or greater.

8. The method of manufacturing the copper alloy sheet according to claim 6, wherein the heating time from 100° C. to 700° C. in the solution heat treatment step is 20 sec or less.

9. The method of manufacturing the copper alloy sheet according to claim 6, in the solution heat treatment step of which heat treatment is carried out with the holding time and ultimate attaining temperature in the range of 700° C. to 850° C. set so that the average grain diameter of the recrystallization grains after the solution heat treatment becomes 10 μm-60 μm.

10. The method of manufacturing the copper alloy sheet according to claim 6, wherein when finish cold rolling is conducted, 150° C.-550° C. low-temperature annealing is conducted after the finish cold rolling.

* * * * *